US007891911B2

(12) United States Patent
Tschernuth et al.

(10) Patent No.: US 7,891,911 B2
(45) Date of Patent: Feb. 22, 2011

(54) FRICTION TUBE ANCHOR AND INFLATION ADAPTER FOR THE LATTER

(75) Inventors: Christof Tschernuth, Villach (AT); Martin Neuhold, Ferndorf (AT); Michael Meidl, Seeboden (AT)

(73) Assignee: Atlas Copco MAI GmbH, Feistritz an der Drau (AT)

( * ) Notice: Subject to any disclaimer, the term of this patent is extended or adjusted under 35 U.S.C. 154(b) by 404 days.

(21) Appl. No.: 11/990,619

(22) PCT Filed: Jul. 26, 2007

(86) PCT No.: PCT/AT2007/000366

§ 371 (c)(1),
(2), (4) Date: Feb. 19, 2008

(87) PCT Pub. No.: WO2008/019409

PCT Pub. Date: Feb. 21, 2008

(65) Prior Publication Data

US 2009/0035071 A1 Feb. 5, 2009

(30) Foreign Application Priority Data

Aug. 17, 2006 (AT) ..... A 1382/2006

(51) Int. Cl.
*E21D 21/00* (2006.01)

(52) U.S. Cl. ..... 405/259.3; 405/259.1; 405/288; 411/19; 52/711

(58) Field of Classification Search ..... 405/259.3, 405/288, 259.1; 411/19; 52/745.21, 704, 52/711

See application file for complete search history.

(56) References Cited

U.S. PATENT DOCUMENTS 4,100,748 A * 7/1978 Hansen ..... 405/259.3

FOREIGN PATENT DOCUMENTS

| | | |
|---|---|---|
| WO | 2004/099571 A1 | 11/2004 |
| WO | WO 2005/073510 | 8/2005 |
| WO | WO 2005/119009 | 12/2005 |
| WO | WO 2006/066288 | 6/2006 |

OTHER PUBLICATIONS

Search Report in corresponding Austrian Application GM 8067/2007 dated Jul. 2, 2007.

* cited by examiner

*Primary Examiner*—David J Bagnell
*Assistant Examiner*—Sean Andrish
(74) *Attorney, Agent, or Firm*—Young & Thompson

(57) ABSTRACT

A friction tube anchor has a tube (1) which can be expanded under the action of a pressurized medium and which is attached to a casing (6). The casing (6) is screwed into a section (13) of a casing-like sleeve (7) which is provided with a thread and is sealed by ring packing (11) relative to the inside of the section (13). The casing-like sleeve (7) has another section (14) which is provided with a thread and in which selectively either another expandable tube (1), or an adapter for feeding the pressurized medium for expanding the tube (1), or a fastening bolt, for example an eye bolt, can be screwed.

37 Claims, 16 Drawing Sheets

FRICTION TUBE ANCHOR AND INFLATION ADAPTER FOR THE LATTER

FIELD OF THE INVENTION

The invention relates to a friction tube anchor.

BACKGROUND OF THE INVENTION

Friction tube anchors are known, in which connection for example reference can be made to U.S. Pat. No. 4,459,067 A and WO 2006/066 288 A.

Friction tube anchors are rock anchors which have a tube which is folded to the inside in the lengthwise direction and which is placed in a bore hole and expanded by increasing the pressure within the folded tube so that the outer surface of the tube adjoins the inner surface of the bore hole and thus fixes the anchor in the bore hole.

In the known friction tube anchor (compare FIG. 1) the front end of the expandable tube 1 is closed by an end casing 2. The tube 1 has a wall which is folded to the inside essentially over its entire length (omega-like) (FIG. 2). The back end of the tube 1, therefore the end which is adjacent to the opening of the bore hole (the outer end of the bore hole) extends through an anchor plate 3 and bears an inflation jacket 4 with an inflation hole 5. Via an adapter attached to the inflation jacket 4 pressurized fluid (especially water) is delivered into the interior of the tube 1, and the tube 1 is expanded as the lengthwise fold of the tube 1 is unfolded so that the friction tube anchor is fixed in the bore hole by friction and positive locking.

WO 2004/099571 A also discloses attaching screw bolts, for example eye bolts, to the outer end pieces of these friction tube anchors to accommodate loads.

SUMMARY OF THE INVENTION

The object of the invention is to expand possible applications of friction tube anchors of the initially mentioned type while maintaining the advantages of friction tube anchors.

This object is achieved with a friction tube anchor which has the features described herein.

Preferred and advantageous configurations of the invention are described below.

Since in the friction tube anchor as claimed in the invention there is a casing-like sleeve which is connected to one end of the expandable tube of the friction tube anchor, optionally with a casing joined in between, there are several different possible applications.

Thus, the casing-like sleeve which is provided in the friction tube anchor as claimed in the invention can be used to couple several expandable tubes of friction tube anchors to one another so that the effective length of the friction tube anchors is increased and better holding, especially in friable rock or loose subsoil, is achieved.

The casing-like sleeve on one end of the expandable tube of the friction tube anchor can also be used to connect an inflation adapter to the expandable tube, by which pressurized fluid (water) from a pressure source is routed into the friction tube anchor to expand the tube.

Finally, the casing-like sleeve which is provided in the friction tube anchor as claimed in the invention can also be used to join other components to the friction tube anchor after it has been expanded and fixed in the subsoil. These components can be components such as bolts, especially screws, eye bolts or the like which can be screwed in. In this case the casing-like sleeve forms a hanger jacket.

If in the friction tube anchor as claimed in the invention the casing-like sleeve is used as a hanger jacket, a casing which is connected to the expandable tube of the friction tube anchor and from the other end a bolt, especially an eye bolt or the like, can be inserted, especially screwed into the casing-like sleeve from one side. Thus an especially simple structure of the friction tube anchor as claimed in the invention arises and it becomes possible to fix it in a bore hole by an inflation adapter being attached (inserted) via the end (thread) of the casing-like sleeve into which the fastening bolt is inserted (screwed) later; the pressurized medium which is necessary for expanding the tube of the friction tube anchor is fed via the adapter. Thus the operating reliability of the friction tube anchor as claimed in the invention is ensured.

The invention can be fundamentally used in all types of friction tube anchors, especially also in friction tube anchors of the design known from WO 2006/066288A.

In one embodiment of the friction tube anchor as claimed in the invention, the casing-like sleeve is made with two threaded sections so that casings which are connected to the expandable tubes of the friction tube anchors and/or other components such as bolts, eye bolts and the like as well as the inflation adapter can be screwed in. It is preferable in this connection if the thread for holding the casings which are joined to the expandable tubes of the friction tube anchors are round threads, and threads for holding inflation adapters or other components such as bolts are metric threads.

Within the framework of the invention, it is considered that the thread in which on the one hand the casing for the expandable tube of the friction tube anchor and the thread into which the inflation adapter for expanding the tube or the attachment bolt is screwed, on the other, is a thread which runs in the same direction or in opposite directions.

For example, the thread for holding the casing is a left-hand thread (round thread) and the thread for holding the inflation adapter or the fastening bolt is a right-hand thread (metric thread).

Within the framework of the invention it can be provided that the casing in which the expandable tube of the friction tube anchor is fixed has an outside thread, for example a round thread.

In order to seal the casing relative to the casing-like sleeve, especially the hanger jacket, on its outside there can be a seal, especially an O-ring.

When the friction tube anchor as claimed in the invention is set, an inflation adapter via which the pressure medium is supplied is screwed into the end of the casing-like sleeve, which end in the position of use points to the outside, therefore toward the open end of the bore hole. This inflation adapter has a distance from the casing or from the expandable tube which has been attached in it. The pressurized medium for an expandable tube with a tightly welded end enters the expandable tube exclusively via an outside hole, for example via a hole which is provided in the wall of the casing.

If according to one embodiment of the invention in the weld on the tightly welded end of the expandable tube there is at least one opening for the passage of the pressurized medium into the interior of the welded tube, an opening in the wall of the expandable tube is as unnecessary as a radial opening in the casing.

In one embodiment of the invention, it is provided that the expandable tube is connected, for example welded, to the casing which has been inserted into the casing-like sleeve, especially screwed in via a rolled thread.

In order to facilitate the entry of the liquid for expanding the tube of the friction tube anchor from the outside, especially via the hole in the wall of the casing, in the transition between the regions of the casing-like sleeve into which the casing or a bolt is inserted, especially in the transition between the two threaded sections of the casing-like sleeve, there is a region with an enlarged cross section which is made especially without threads. This thread-free region with an enlarged diameter however need not be present if there is a round thread, since the fluid which expands the expandable tube, as a result of the tolerance of the round thread in the threaded region, can flow as far as the radial opening in the casing which has been attached to the expandable tube and can enter the expandable tube there.

This thread-free region on the inside of the casing-like sleeve can be omitted when expandable tubes with open welding or expandable tubes with closed welding and opening in the weld are used.

In one embodiment of the invention the casing-like sleeve is made as a "hanger casing" and has a section with a round thread and a section with a metric thread, and the expandable tube of the friction tube anchor can be screwed into the round thread via the casing which is connected to this tube. A bolt, for example an eye bolt, can be screwed into the metric thread. In this embodiment the pressurized fluid which is necessary for expanding the expandable tube is fed via the inflation adapter which has been screwed into the metric thread of the sleeve (hanger jacket). This fluid can flow either directly axially into the omega profile of the expandable tube at this point (for open welding of the profile of the expandable tube). For closed welding, the fluid, like in a conventional friction tube anchor, enters the interior of the expandable tube via at least one radial hole which has been drilled through the expandable tube and the welded-on casing, or through at least one axial hole which is provided in the weld.

The expression "open welding" (shown in FIG. 18 of the drawings) is defined as welding of the expandable tube ("profile") in which a bridge is welded in the middle of the expandable tube, conversely the interior of the expandable tube is open on its ends in the axial direction so that axial entry of pressurized fluid (water) into the tube to expand it is possible.

The expression "closed welding" (shown in FIGS. 12 and 23 and 24) is defined as welding in which the inside clear opening of the expandable tube ("profile") is welded outside on its end, therefore is tightly sealed. Fluid which is supplied to expand the tube enters the expandable tube via at least one radial hole or via at least one opening in the weld into the interior of the expandable tube.

One difference between "open welding" and "closed welding" is the welded cross section of the profile. In this connection, for "closed welding" there is an increased welded steel cross section so that the failure load is higher than in an "open welded" profile. In "open" welding the profile is not welded tight, so that the pressurized fluid which is required for expansion can emerge axially into the casing-like sleeve. For closed welding on the other hand the profile is welded tight, is therefore closed on its end which is held in the casing-like sleeve so that a radially arranged hole is necessary in the wall of the expandable tube or an opening in the weld is necessary through which fluid can enter and emerge.

In one embodiment the casing-like sleeve with two sections is made with round threads which are designed to hold one expandable tube of a friction tube anchor each via the casings fixed on their end by screwing in. In this connection the fluid required for the expansion of the expandable tubes at this point can emerge either axially from the (open-welded) expandable tube and can penetrate axially into the expandable tube which has been screwed in behind it, or the fluid emerges radially through a hole or axially through an opening in the weld from the expandable tube which has been welded closed, flows through the interior of the casing-like sleeve and for the second tube which has been screwed into the sleeve penetrates in turn through a radial hole or through an opening (axial hole, for example drilled hole) in the weld into the interior of the expandable tube.

Fundamentally, within the framework of the invention there are especially for example the following combinations:

An individual friction tube anchor with casing-like sleeve (hanger jacket) which has been screwed on, and an eye bolt, two or more friction tube anchors screwed together with the casing-like sleeve screwed on, and an eye bolt and two or more friction tube anchors screwed together with a normal end casing with an inflation hole and an anchor plate (similar to as shown in FIG. 1).

The invention also relates to an inflation adapter which in conjunction with the casing-like sleeve of the friction tube anchor of the invention provided as claimed in the invention can be used especially advantageously.

This inflation adapter as claimed in the invention is characterized by the features named in the independent claim directed at the inflation adapter.

Preferred and advantageous embodiments of the inflation adapter as claimed in the invention are the subject matter of the dependent claims.

Other details and features of the invention will become apparent from the following description of one preferred embodiment using the drawings.

DETAILED DESCRIPTION OF EMBODIMENTS

Figure 2:
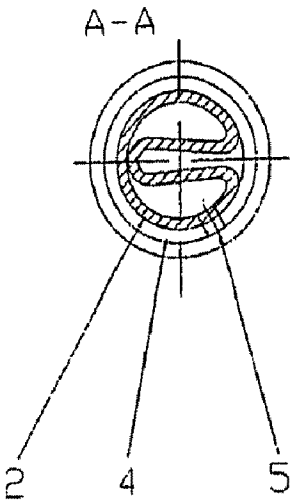
Fig. 2 Prior Art
Figure 3:
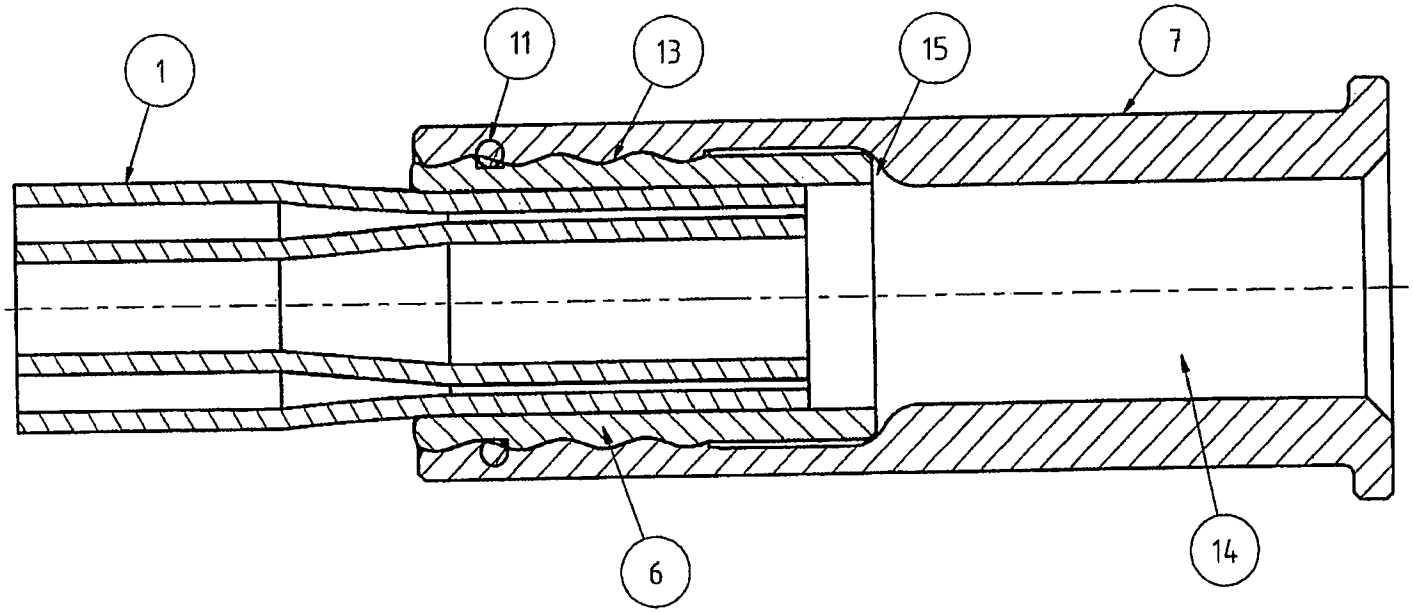
Figure 4:
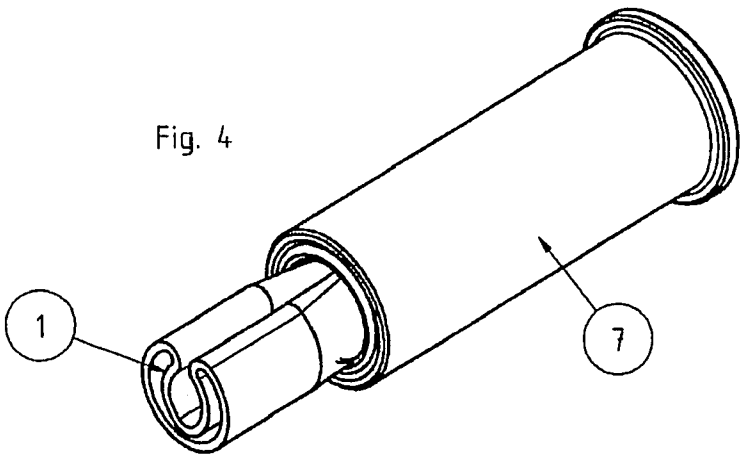
FIG. 4 shows an oblique view of the friction tube anchor from FIG. 3.
Figure 5:
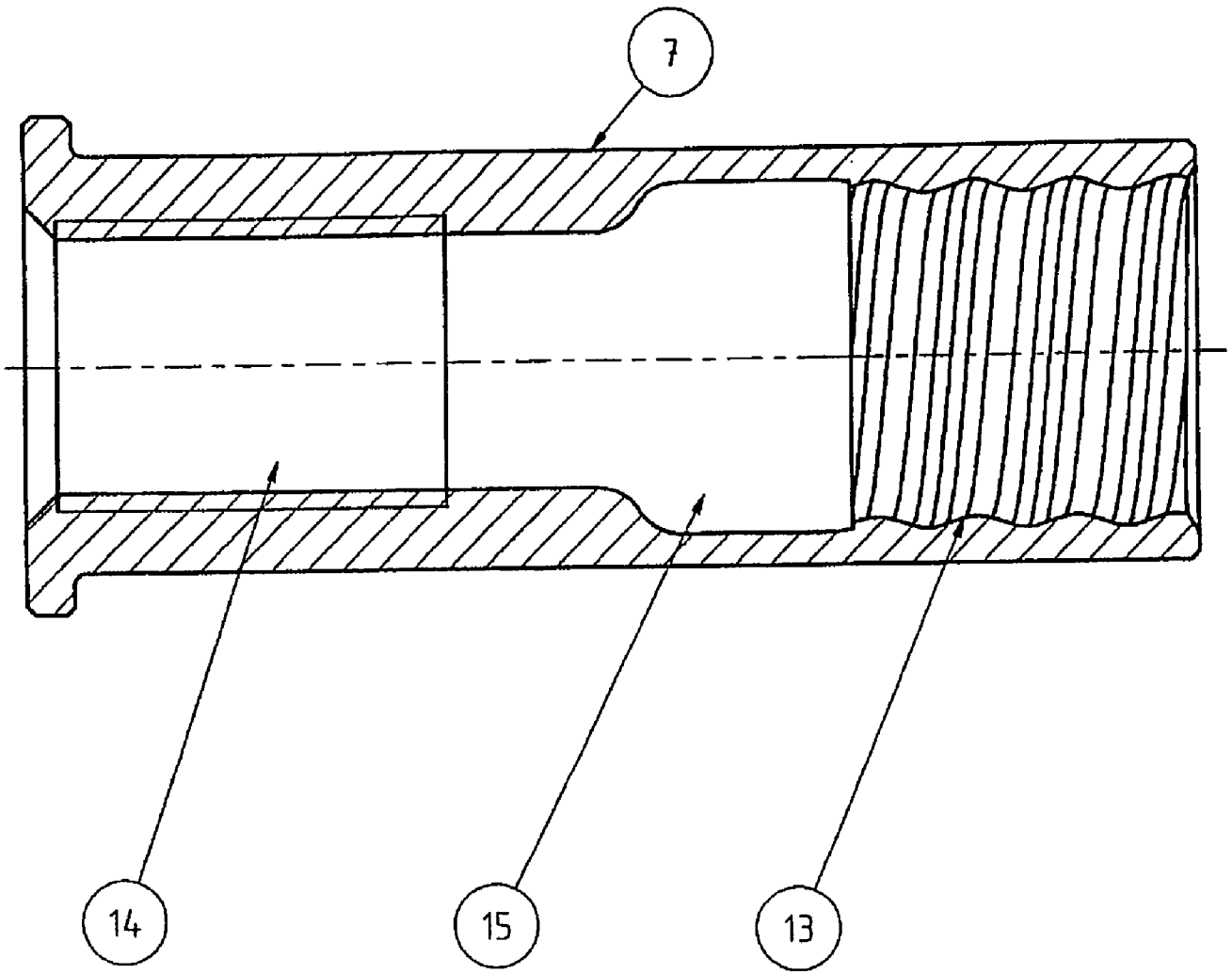
FIG. 5 shows in an axial section the casing-like sleeve which is used as the hanger jacket, FIG. 6 a casing in an axial section, FIG. 7 in an axial section a casing-like sleeve with an expandable tube which has been inserted from one end, and an inflation adapter inserted into the other end of the casing-like sleeve for feeding pressurized fluid.

A friction tube anchor as claimed in the invention has an expandable tube 1 of metal which has been folded omega-like (compare FIG. 2) in the initial state and which on one of its ends (the tube in FIGS. 3 and 4 is shown only partially and on its end which is not shown in FIGS. 3 and 4 is closed by the end casing 2) is connected to a casing 6, and via this casing 6 is screwed into a casing-like sleeve 7 which is made here as a hanger jacket.

The expandable tube 1 of the friction tube anchor is connected to the casing 6 especially by welding. In this connection "open welding", compare FIG. 18, or "closed welding", compare FIG. 12 or FIGS. 23/24, can be chosen.

The casing 6 on its outside has a round thread 8 and a peripheral groove 9 which is open to the outside and into which O-ring packing 11 is inserted. Instead of the ring packing 11 inserted into the peripheral groove 9, any other seal of the casing 6 relative to the casing-like sleeve 7, such as for example a flat seal, is likewise considered within the framework of the invention. The section 13 of the casing-like sleeve 7 which is designed to hold the casing 6 and the tube 1 connected to it is provided with an inside thread (round thread) which corresponds to the (rolled) outside thread 8 of the casing 6.

The casing-like sleeve 7 has another section with a thread 14, and the thread in sections 13 and 14 can be in the same direction or opposite direction. For example the thread in section 13 for holding the casing 6 is a left-handed thread and the thread in section 14 is a right-handed thread. The thread in section 14 can be a metric thread.

In the region 15 between the threaded sections 13 and 14, in one preferred embodiment in the casing-like sleeve 7 there is an unthreaded region 15 with an enlarged diameter. As already indicated, especially when the casing 6 on the outside has a round thread and the casing-like sleeve 7 in its region 13 has a round thread, between the section 13 and the section 14 of the casing-like sleeve 7 there need not be an unthreaded section with an enlarged diameter. This applies especially when the end of the expandable tube 1 which is connected to the casing 6 has "open welding". But even if the end of the tube 1 which lies in the region of the casing 6 is made with "closed welding", the unthreaded region which optionally also has an enlarged diameter (region 15 of the casing-like sleeve 7) is not critical. As mentioned, the pressurized fluid due to tolerances of the round threads can flow through the threaded section, therefore between the inside surface of the section 14 of the casing-like sleeve 7 and the outside surface of the casing 6.

A bolt, for example an eye bolt (compare FIG. 8), can be screwed into the section 14 of the casing-like sleeve 7 with the internal thread.

When an anchor as claimed in the invention is set, therefore the tube 1 must be expanded, an inflation adapter 20 (compare FIG. 7) is screwed into the section 14 of the casing-like sleeve 7 and is connected to a source for a pressurized medium (for example, water) source, as is known for friction tube anchors. The inflation adapter 20 with its end held within the casing-like sleeve 7 lies next to the end of the casing 6 which lies in the region of the section 15 of the casing-like sleeve 7. The pressurized medium emerges axially from the inflation adapter 20, flows around the inner end of the casing 6 for a tube 1 "welded closed" and enters through the hole 17 provided in the wall of the casing 6 or through an opening in the weld into the interior of the expandable tube 1 of the friction tube anchor and causes the tube 1 to expand and tightly adjoin the inner surface of the bore hole and thus performs its function as a friction tube anchor. When the expandable tube 1 is connected to the casing 6 in the form of "open welding", the pressurized medium can enter directly into the interior of the expandable tube 1 and expands it, as is conventional for friction tube anchors.

After the inflation adapter 20 has been screwed out of the section 14 of the casing-like sleeve 7, a fastening bolt (FIG. 8) can be screwed in. The fastening bolt can be an eye bolt which optionally also remains only temporarily screwed into the casing-like sleeve 7.

Figure 7:
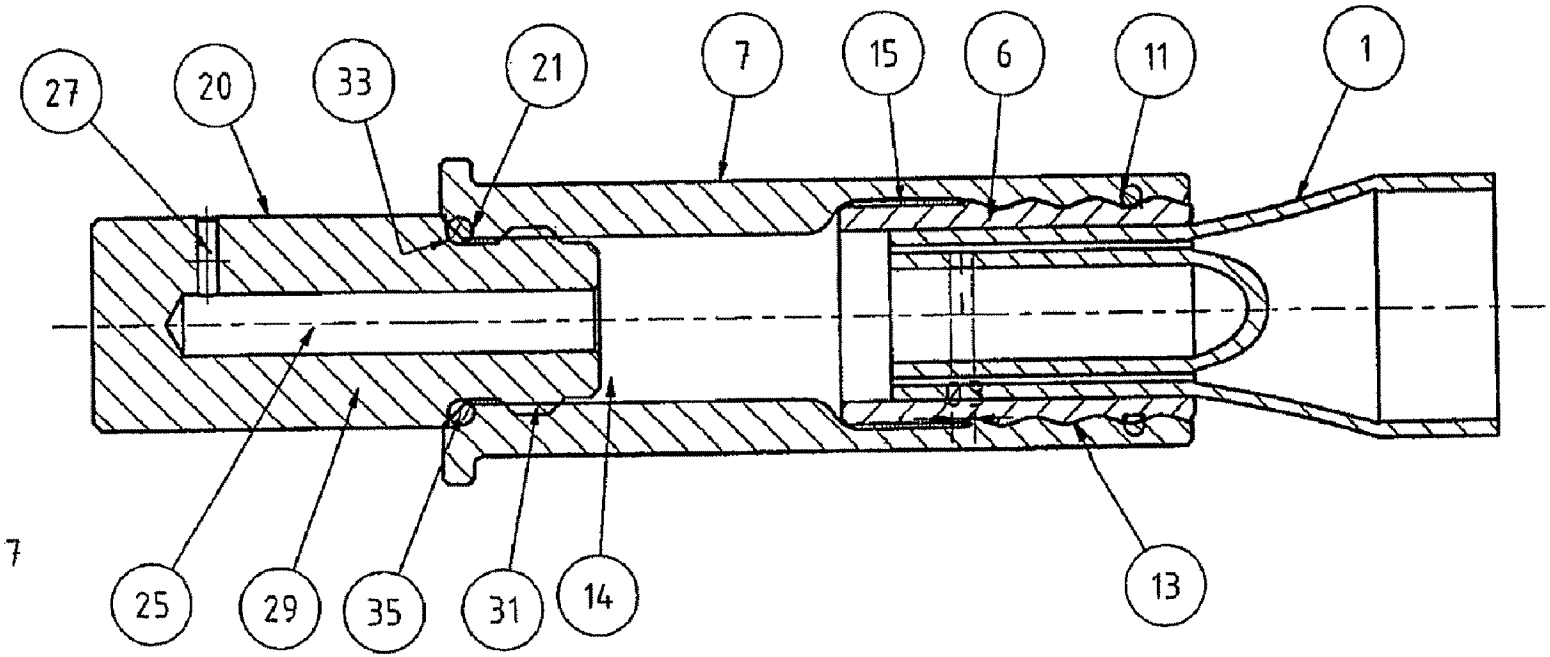

FIG. 7 shows how a casing 6 is screwed into the casing-like sleeve 7 in the region of the section 13 with a round thread, with which sleeve an expandable tube 1 is welded in the manner of a closed weld, so that the tube 1 on its end which lies in the region of the casing 6 is closed. The end of the casing 6 which lies in the unthreaded region 15 of the casing-like sleeve 7 is made without a thread.

Figure 6:
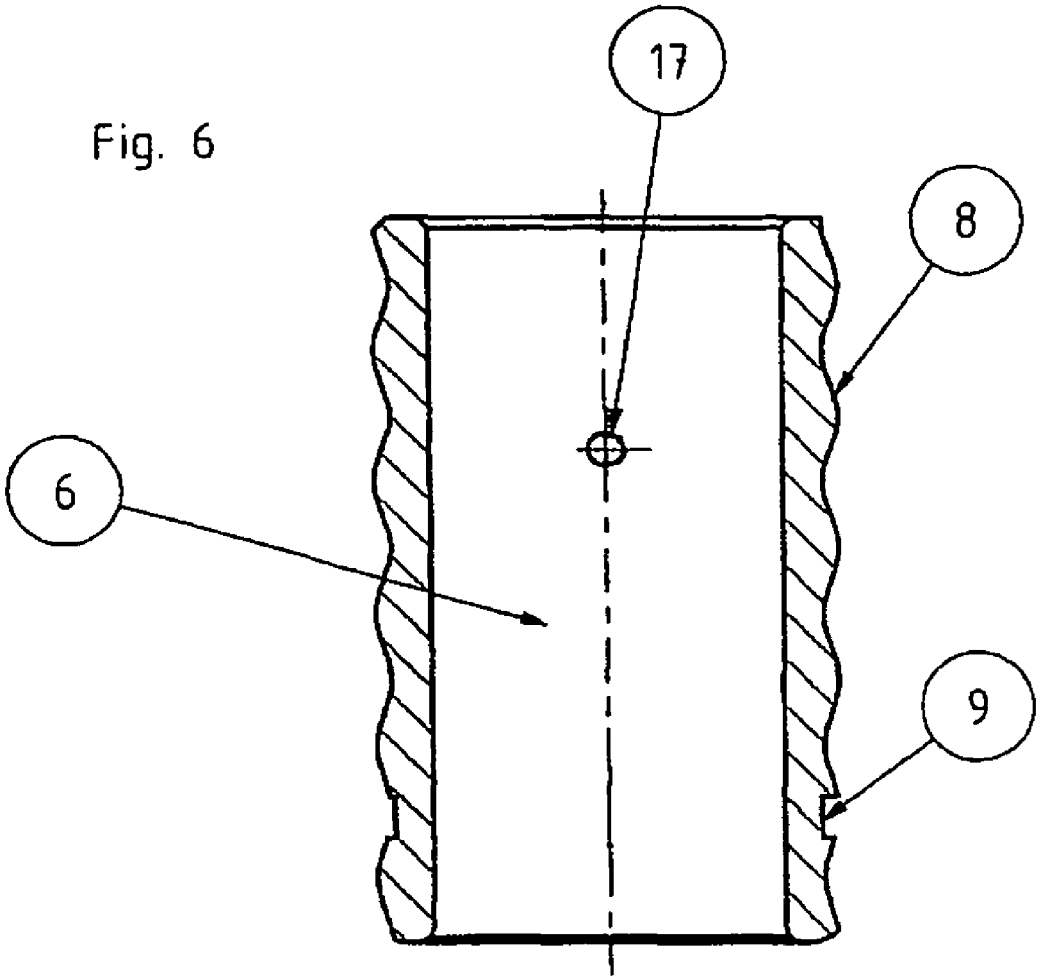

From the side opposite the tube 1 an inflation adapter 20 is screwed into the casing-like sleeve 7 into the metric thread which is located there in the section 14 and is sealed relative to the sleeve 7 by ring packing (O-ring) 21. Since in the arrangement which is shown in FIG. 6, the expandable tube 1 in the region of its casing 6 is closed ("closed welding"), the fluid which has been supplied via the inflation adapter 20 enters the interior of the tube 1 through radial holes 17 of the casing 6 and in the wall of the tube 1 and expands it as is indicated in FIG. 7.

Figure 1:
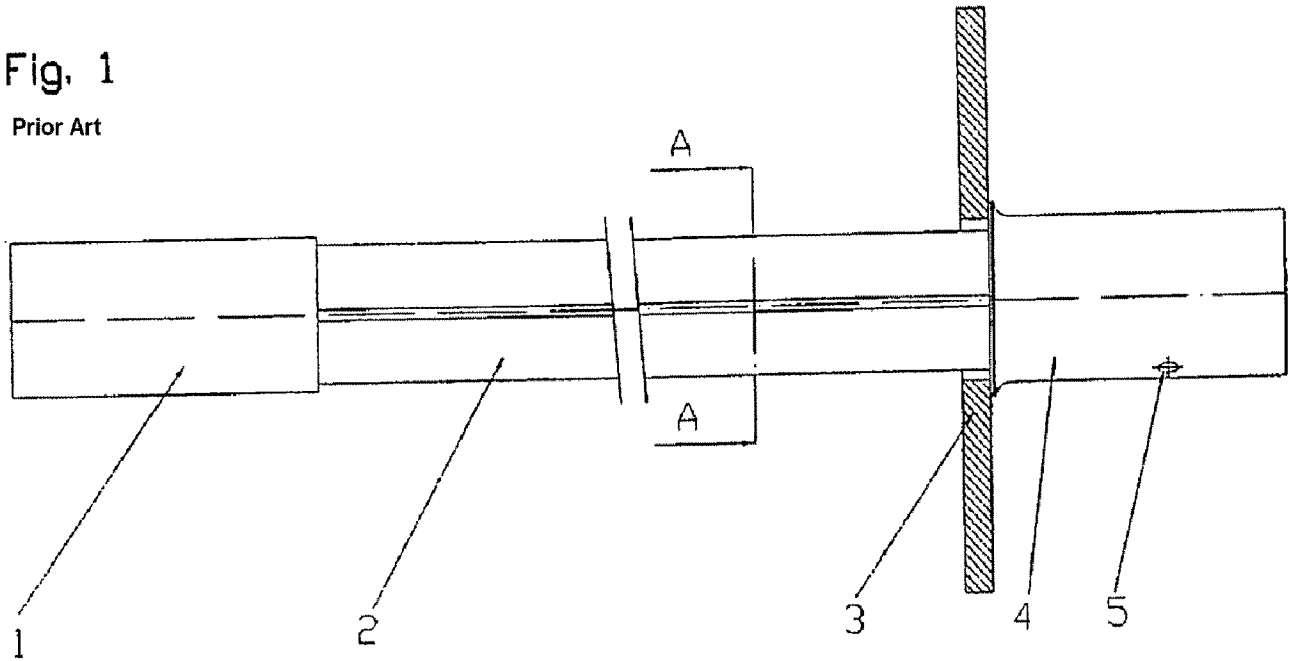
Fig. 1 Prior Art
FIG. 1 shows a friction tube anchor with a schematically shown expandable tube, FIG. 2 a section along line A-A in FIG. 1, FIG. 3 an expandable tube with a casing and casing-like sleeve in a section.
Figure 8:
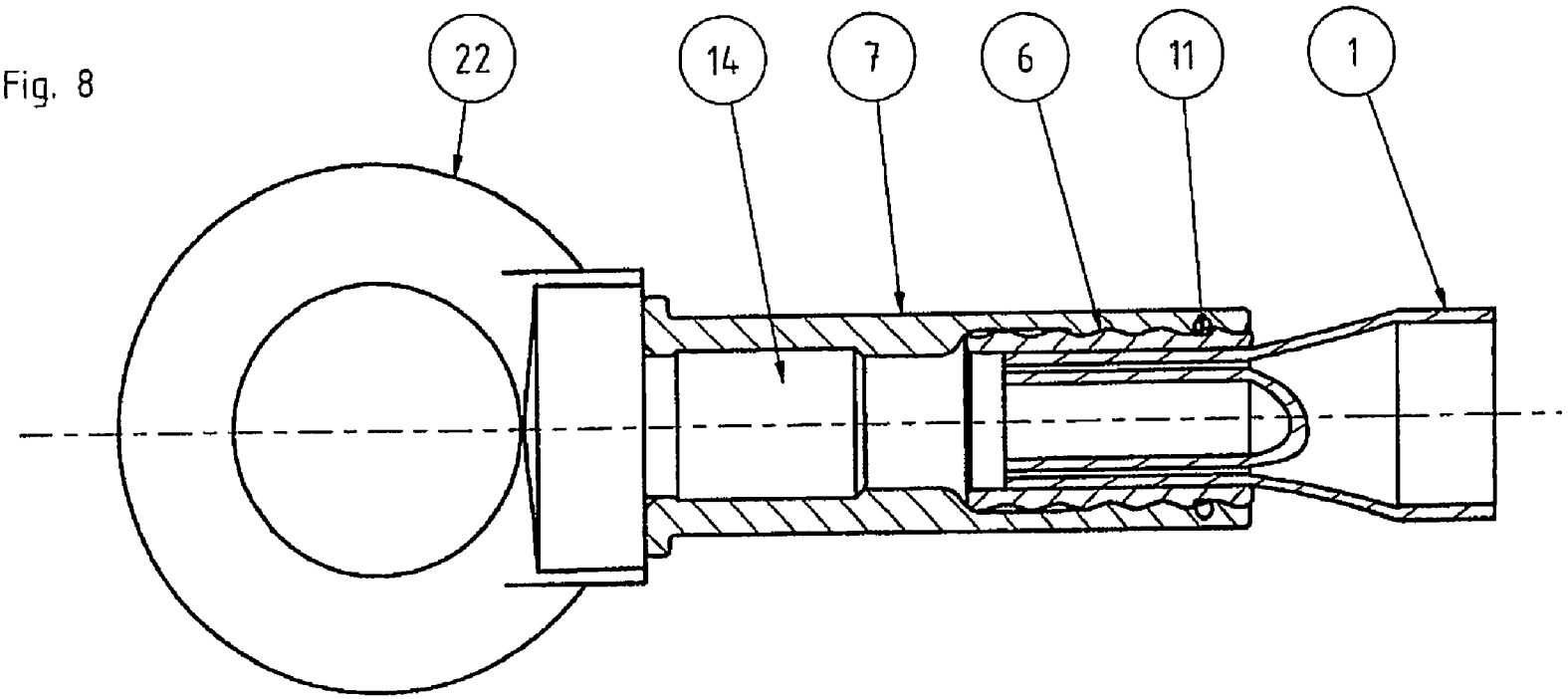
FIG. 8 shows a casing-like sleeve with an expanded tube which has been screwed in from one end via a casing and with an eye bolt screwed into the other end of the casing-like sleeve, FIG. 9 in an axial section a casing-like sleeve with tubes which have been screwed in from both sides.

FIG. 8 shows how another component can be screwed into the casing-like sleeve 7 after the inflation adapter 20 has been removed. In the illustrated embodiment of FIG. 1 it is an eye bolt 22 which is screwed into the threaded section 14 of the casing-like sleeve 7.

FIGS. 9 to 15 show how using the casing-like sleeve 7 provided as claimed in the invention two expandable tubes 1 can be coupled to one another in order to form a friction tube anchor which is provided with a greater effective length. Here the ends of the tubes 1 are connected to casings 6 which outside have a rolled thread and which are screwed into the threaded sections 13 of the casing-like sleeve 7. In this embodiment, in the casing-like sleeve 7 there are two sections 13 which are provided with a thread and which are made as round threads, so that the casings 6 which have round threads outside can be screwed with the tubes 1 into the casing-like sleeve 7.

Figure 12:
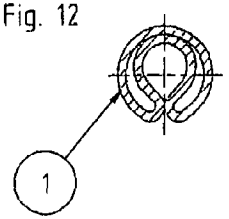
FIG. 12 a section along line B-B in FIG. 9 (only the expandable tube)

FIG. 12 shows that the tubes 1 on their ends which are connected to the casings 6 are made in the manner of "closed welding". Therefore pressurized fluid which has been fed into the interior of one of the tubes 1 flows from one tube 1 via the two radial holes 17 and the unthreaded region 15 between the threaded sections 13 of the casing-like sleeve 7 into the next tube 1.

Figure 9:
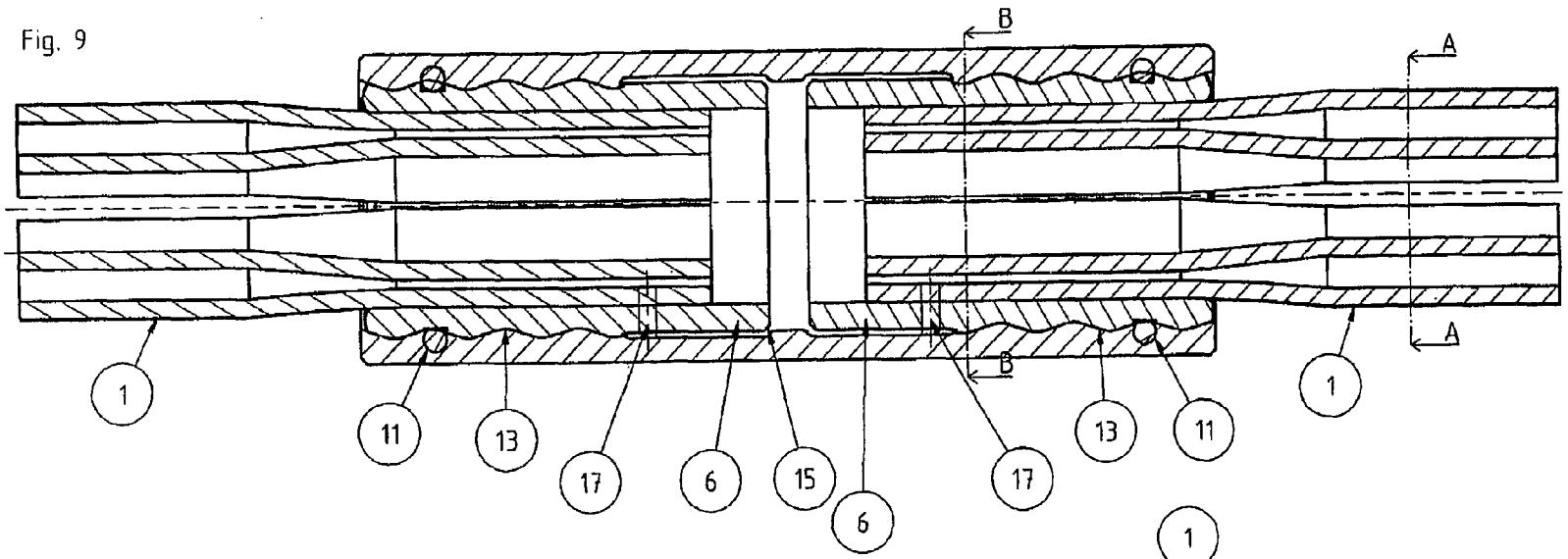
Figure 11:
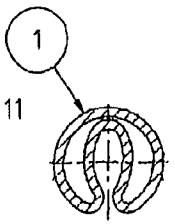
FIG. 11 shows a section along line A-A from FIG. 9.
Figure 13:
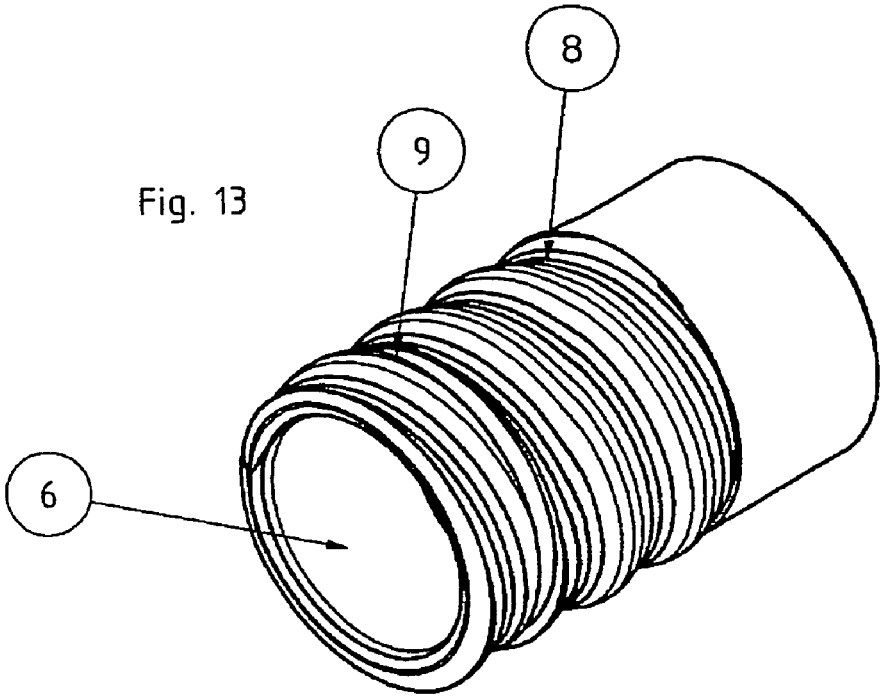
FIG. 13 in an oblique view a casing which can be attached to the end of an expandable tube by welding, FIG. 14 the casing from FIG. 13 in an axial section, FIG. 15 the casing-like sleeve from FIG. 9 for itself alone in an axial section, FIG. 16 another embodiment of a casing-like sleeve with expandable tubes which have been screwed in from both sides via casings.
Figure 14:
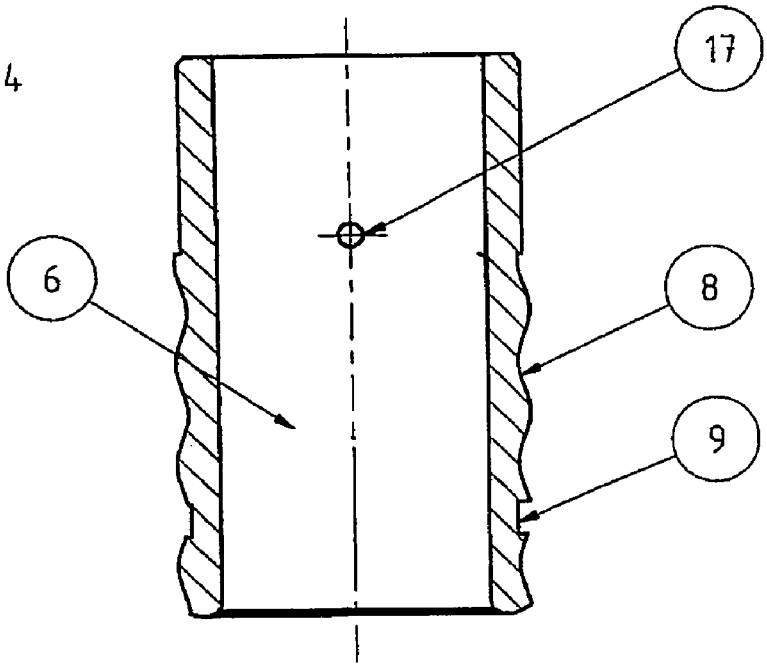
Figure 15:
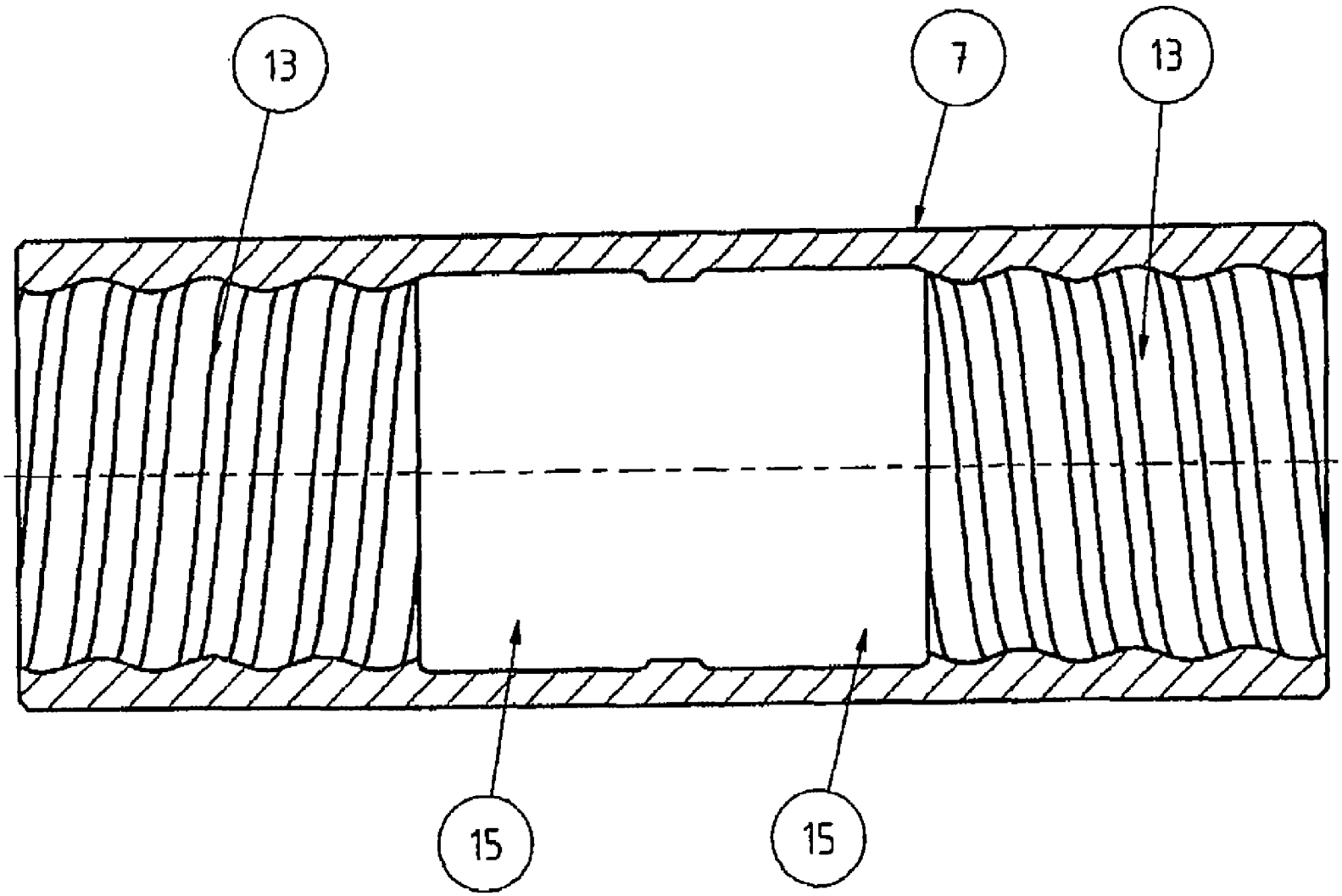

FIGS. 13 and 14 show one embodiment of the casing 6 in an oblique view (FIG. 13) and in a section (FIG. 14), the unthreaded sections and the radial holes 17 being apparent. The casing-like sleeve 7 used in this embodiment of FIG. 9 is shown in FIG. 15 in a section once again for itself. FIG. 15 shows the two sections 13 provided with a thread and the optionally unthreaded region 15 which lies between these sections 13 and which is advantageous for overflow of the fluid for tubes 1 with closed welded ends.

Figures 16, 17, 18:
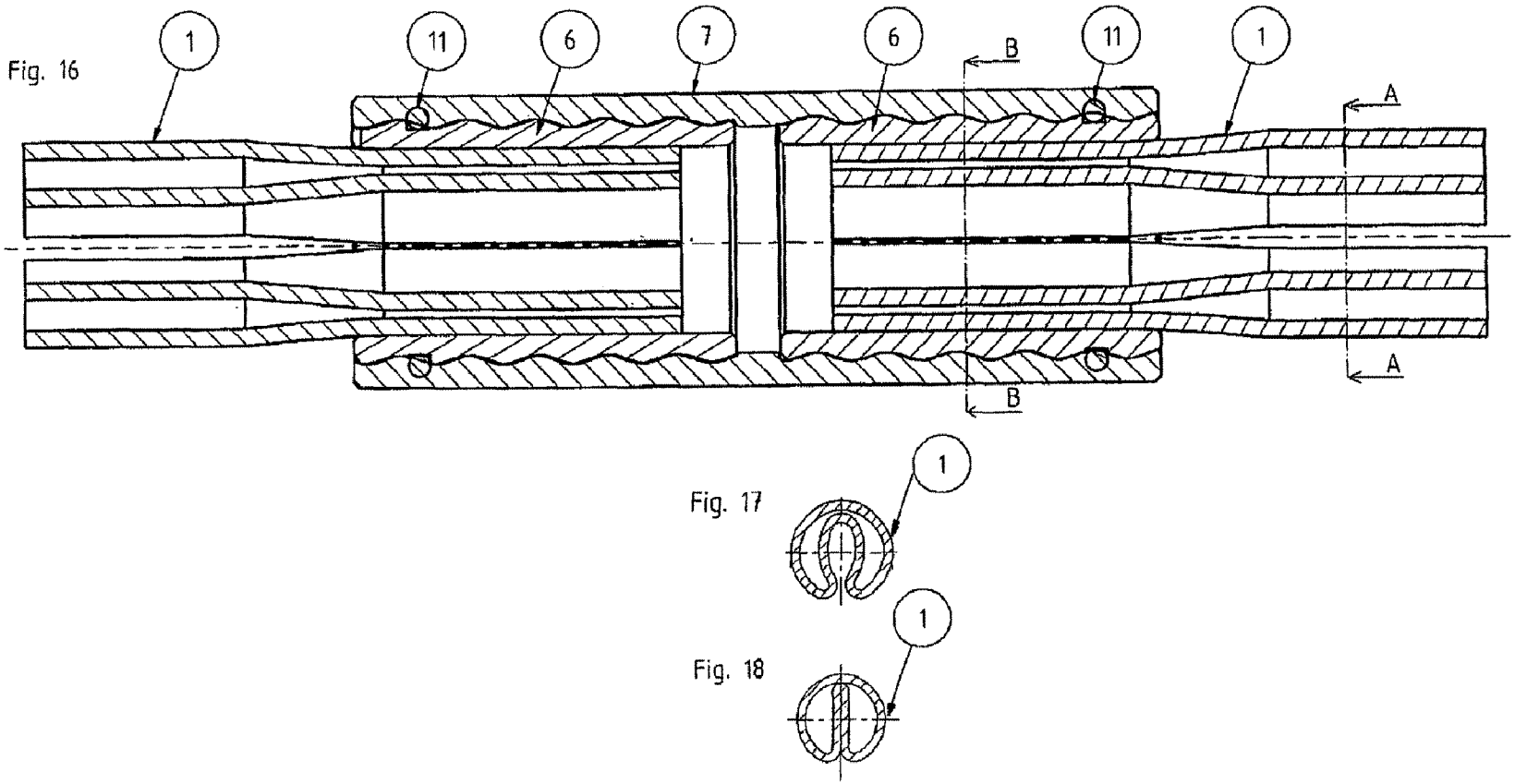
FIG. 17 shows a section along line A-A in FIG. 16, FIG. 18 a section along line B-B in FIG. 16 (expandable tube alone)
Figure 19:
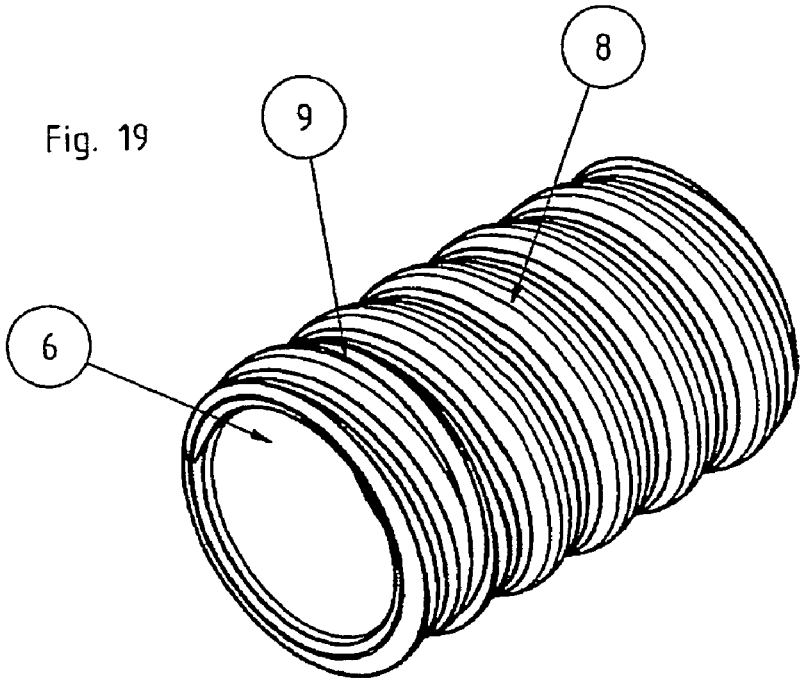
FIG. 19 shows the casing connected (welded) to the expandable tube in an oblique view, FIG. 20 the casing from FIG. 19 in a section, FIG. 21 the casing-like sleeve from FIG. 16 for itself alone in an axial section, FIG. 22 in a view similar to FIG. 3 shows one embodiment with closed welding in a lengthwise section, FIG. 23 an embodiment similar to FIG. 7 for closed welding on the expandable tube in side elevation, FIG. 24 an embodiment similar to FIG. 7 for closed welding on the expendable tube in a lengthwise section.
Figure 20:
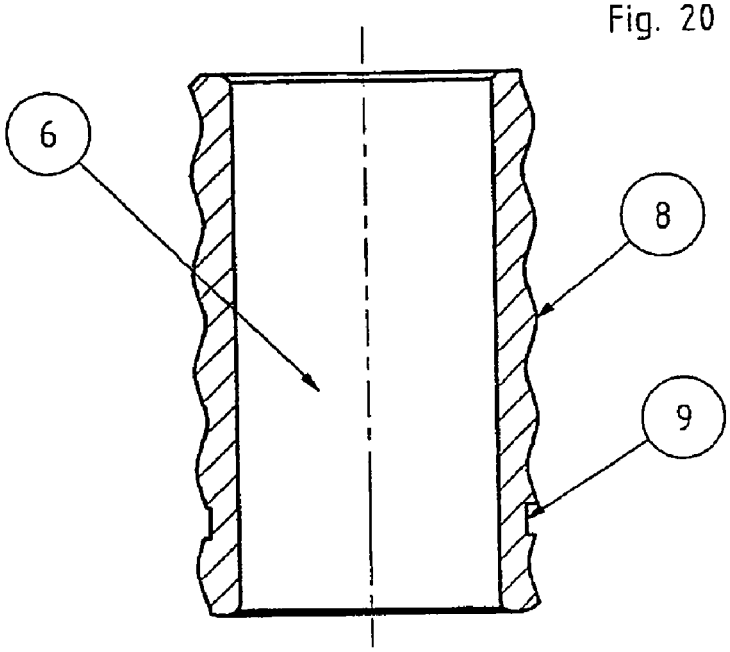
Figure 21:
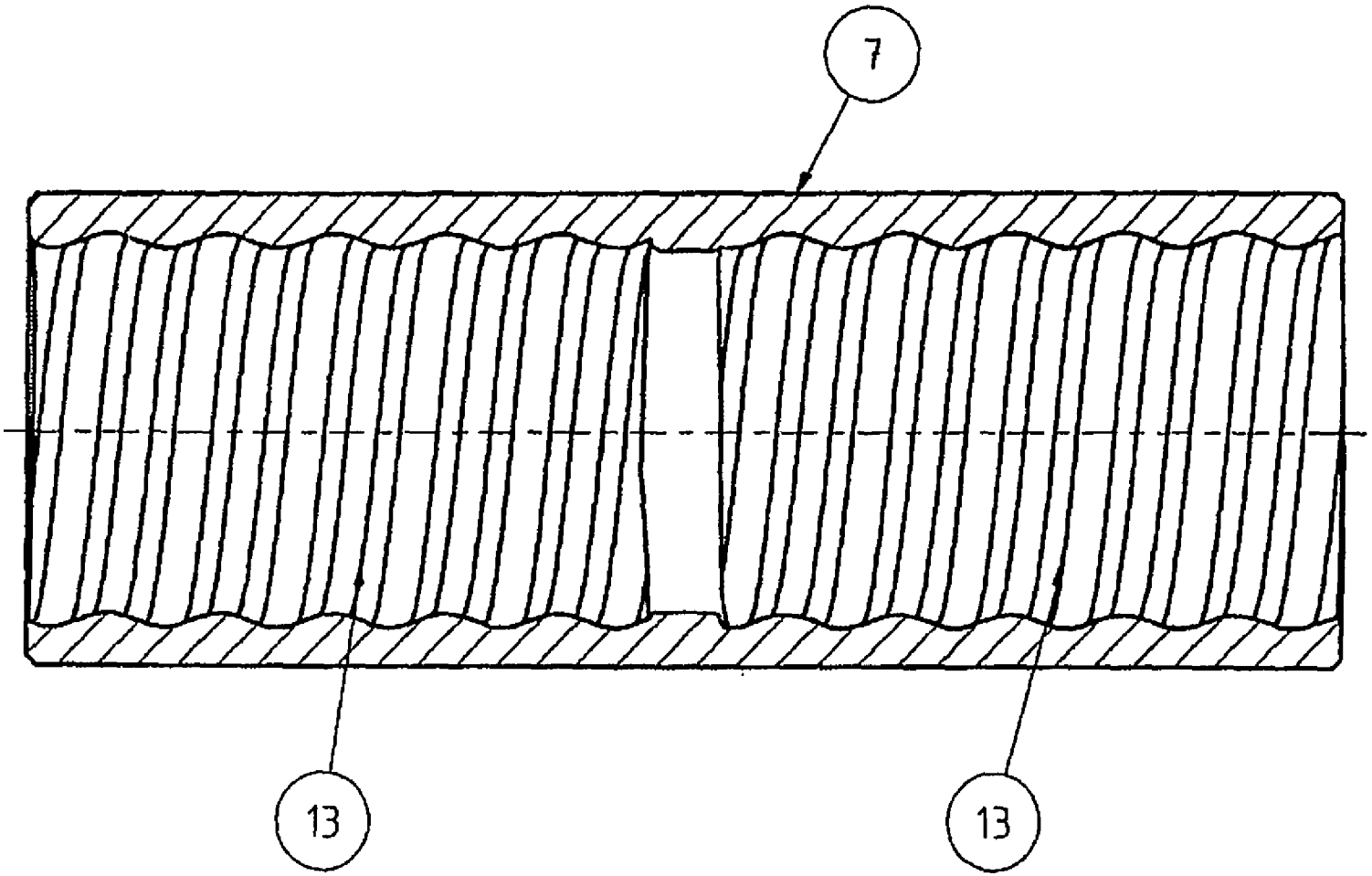

FIG. 16 shows an arrangement similar to the one from FIG. 9. FIG. 17 shows a section along line A-A in FIG. 16 and FIG. 18 shows a section along line B-B in FIG. 16 (expandable tube 1 alone), here the ends of the tubes 1 being connected to the casings 6 with open welding (FIG. 18). In this way unthreaded regions 15 within the casing-like sleeve 7 and the radial holes 17 of the wall of the tubes and in the casings 6 are dispensable, since the fluid can overflow from one tube 1 into the other tube 1 in the axial direction.

An inflation adapter 20 which can be used in conjunction with the casing-like sleeve 7 provided in the friction tube anchor as claimed in the invention is shown in FIG. 7.

This inflation adapter 20 for supplying the fluid (pressurized medium) with which the expandable tube 1 of the friction tube anchor can be expanded via the casing-like sleeve 7 which is connected to it has an axial channel 25. This axial channel 25 is supplied with the pressurized medium from a conventional pressure source via a radial hole 27 which discharges into the axial channel 25.

The inflation adapter 20, as shown in FIG. 7, has a tapered section 29 which projects into the casing-like sleeve 7. This section 29 bears a thread 31 which corresponds to the thread in section 14 of the casing-like sleeve 7. In particular, it is a metric thread.

As FIG. 7 shows, in the inflation adapter 20 as claimed in the invention the thread 31 is not made over the entire axial length of the tapered section 29 of the inflation adapter 20, which section projects into the casing-like sleeve 7, but only in a limited region which lies roughly in the middle of the tapered section 29.

Between the thread 31 of the inflation adapter 20 and the part of the casing-like sleeve 7 which lies outside the latter there is ring packing 21 (O-ring). For the inflation adapter 20 which is inserted, especially screwed into the casing-like sleeve 7, the ring packing 21 is clamped between the adapter-side end of the casing-like sleeve 7 and a shoulder 33 on the inflation adapter 20, therefore the transition region between the section with the tapered diameter and the section of the inflation adapter 20 with a larger diameter. For this purpose the annular end surface of the casing-like sleeve 7 is made inside with a bevel 35.

Figure 22:
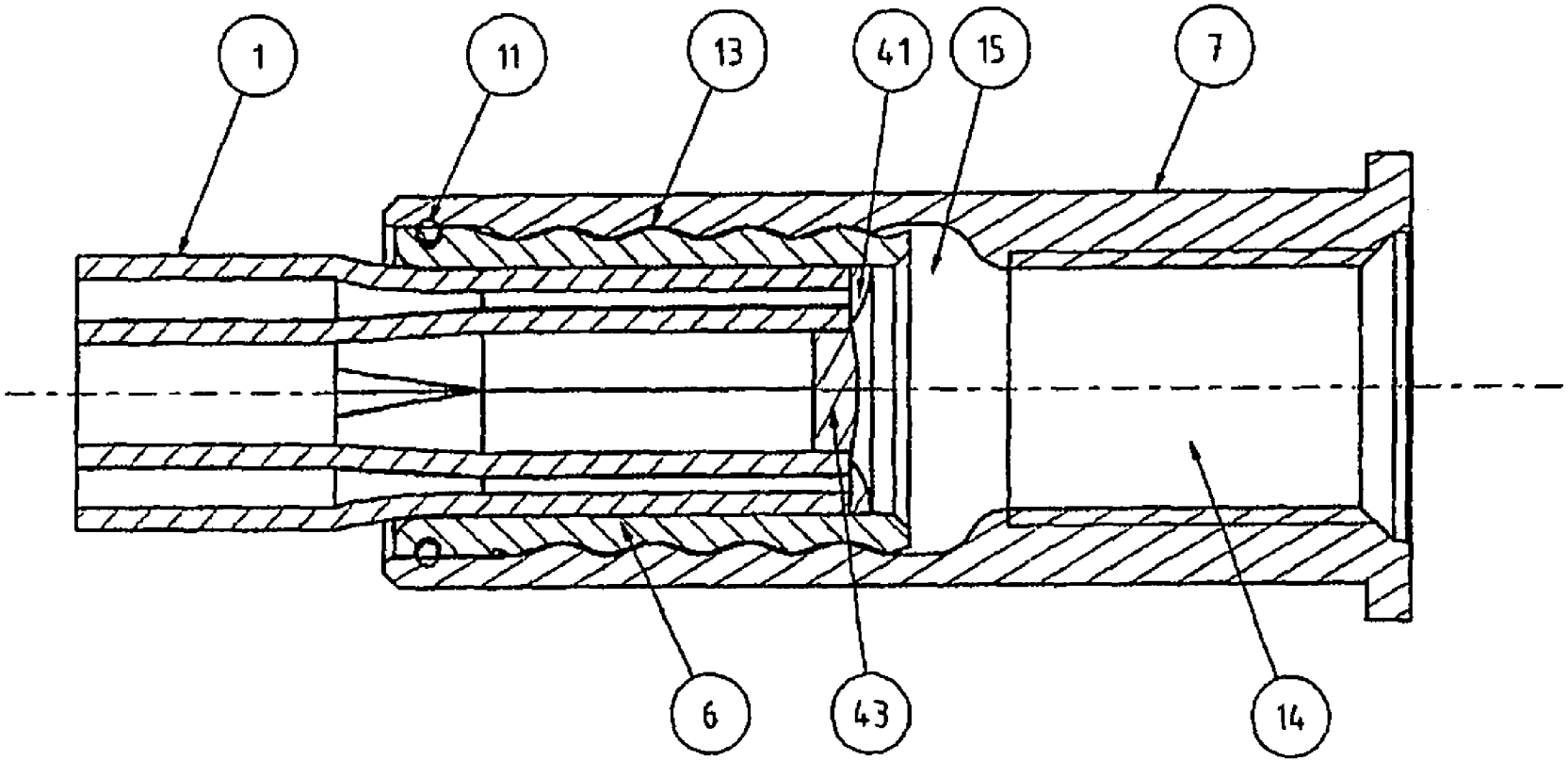

FIG. 22 shows one embodiment of an expandable tube 1 with an end fixed in the casing 6 which is made in the manner of closed welding and which is connected to the casing 6. The weld 41 which is provided on the ends of the expandable tube 1 and seals its interior there also connects the expandable tube 1 to the casing 6.

In addition, in the embodiment shown in FIG. 22 the end which lies in the region of the casing 6 is sealed in the fold of the expandable tube by a plug-shaped insert 43. The plug-shaped insert 43 is connected to the tube 1, for example cemented, pressed or welded.

So that in the embodiment of closed welding of the expandable tube 1 shown in FIG. 22 the pressurized medium for expanding the expandable tube 1 can be fed into its interior, in the weld 41 at least one opening 45 (for example, an axially drilled hole) is made which leads to the interior of the expandable tube 1. Thus the pressurized medium can enter the interior of the expandable tube 1 through the opening 45. It is apparent that in the embodiment with closed welding of the expandable tube 1 and with an opening 45 in the weld 41 for entry of the pressurized medium, the radial holes 17 provided in the other embodiments in the casing 6 (FIG. 6) and the hole which is flush with it in the wall of the expandable tube 1 (FIG. 7) are unnecessary.

Furthermore, in the embodiment with the opening 45 in the welding 41 on the closed, welded end of the expandable tube 1, the unthreaded region 15 in the casing-like sleeve 7 which clears the flow path in the radial holes 17 is dispensable.

Figure 23:
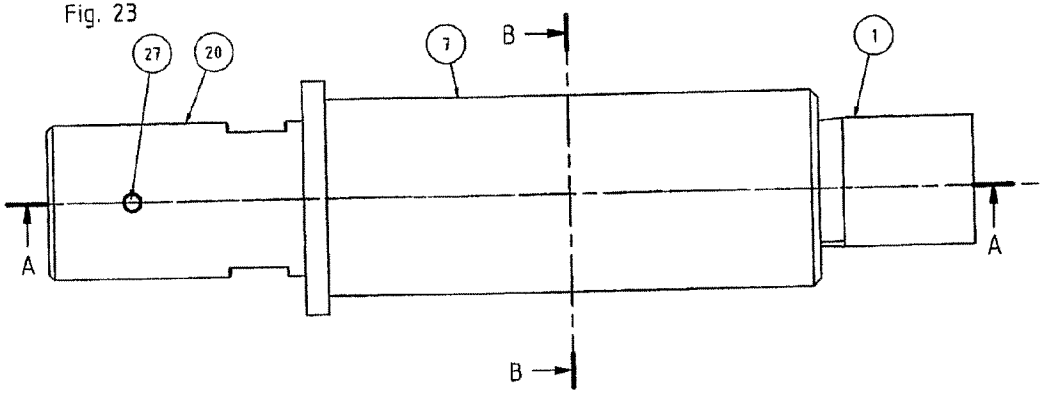
Figure 24:
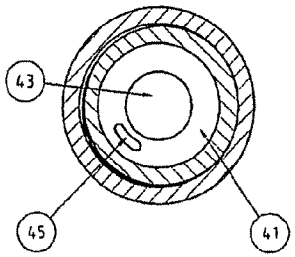

FIG. 23 shows in a side elevation and FIG. 24 in a representation similar to FIG. 7 in a lengthwise section how for an expandable tube 1 with closed welding by a weld 41 with an opening 45 an inflation adapter 20 can be used.

Figure 25:
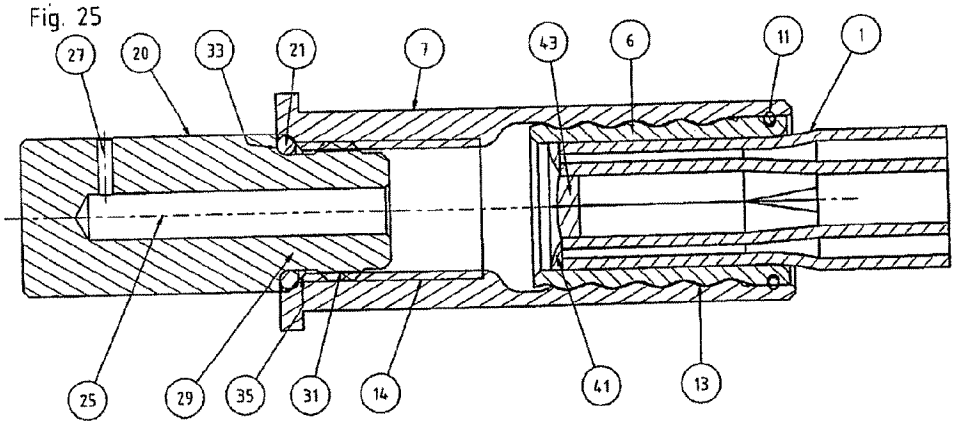
FIG. 25 shows a section along line B-B in FIG. 23, FIG. 26 an embodiment similar to the closed-welded expandable tube from FIG. 8 partially cutaway and FIG. 27 one embodiment (partially) with two expandable tubes which have been joined to one another via a casing-like sleeve, each with closed welding.

FIG. 25 shows in cross section along line B-B in FIG. 23, the closed welding in the embodiment from FIG. 23, with at least one opening 45 in the weld 41.

Figure 26:
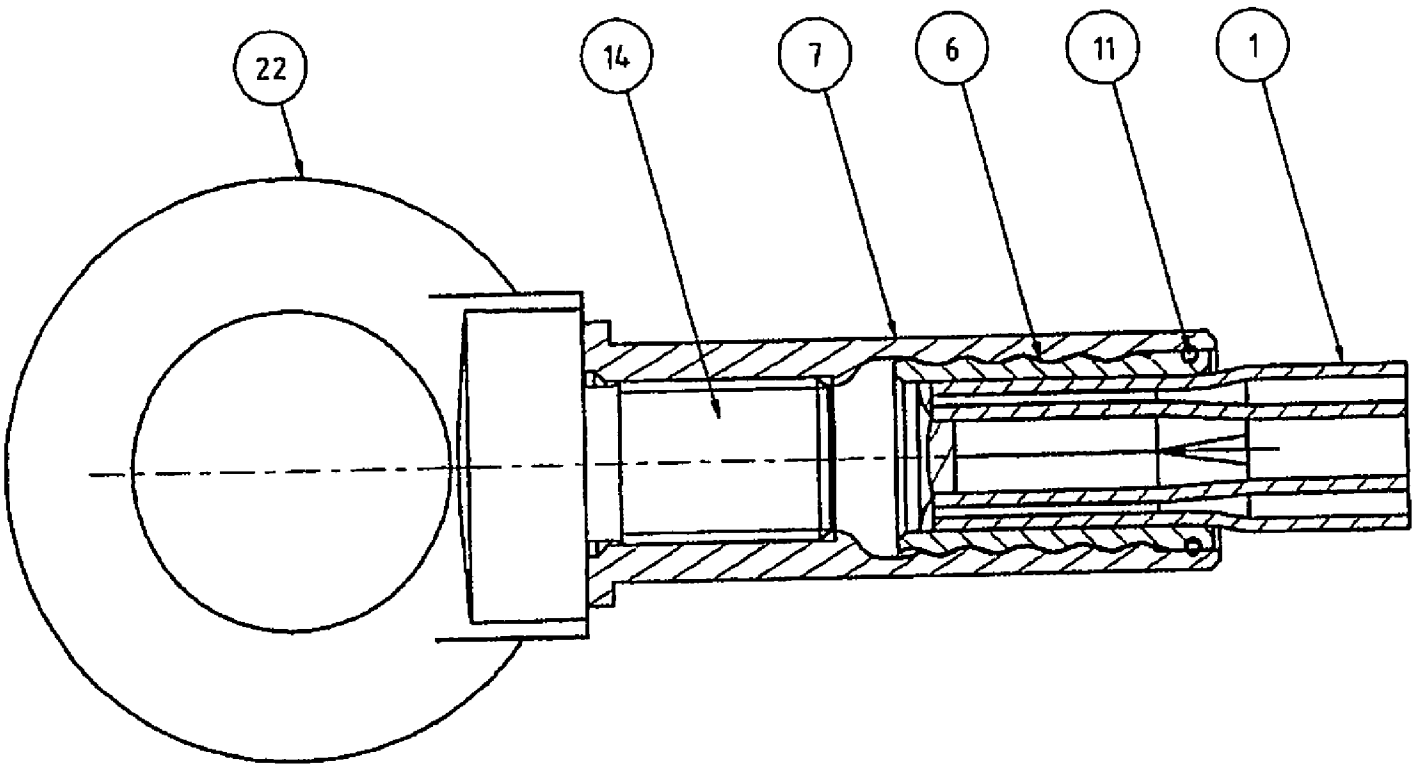

FIG. 26 shows how another component can be screwed into the casing-like sleeve 7 in a closed-welded tube 1.

Figure 27:
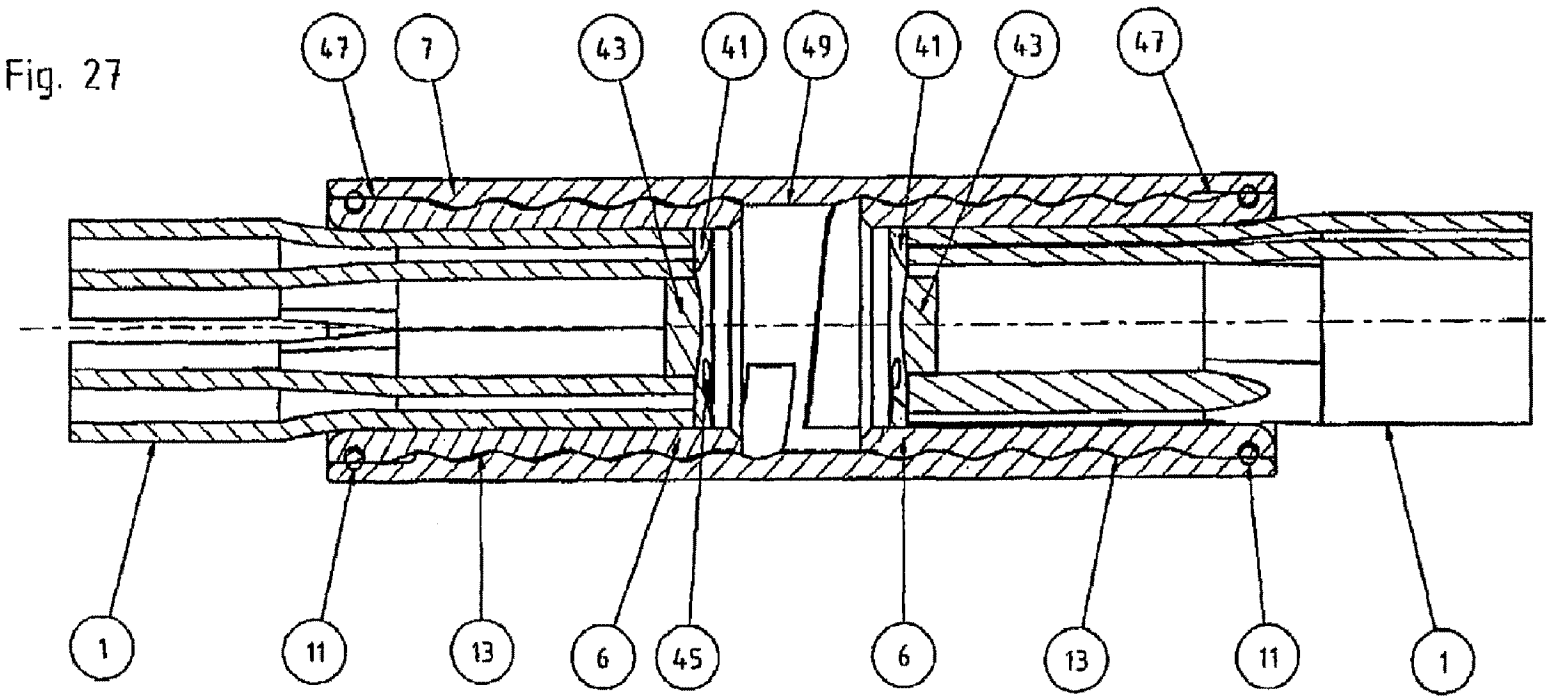

FIG. 27 shows how two expandable tubes 1 which on their adjacent ends with closed welding with a weld 41 in which there is at least one opening 45 can be connected to one another by the casing-like sleeve 7.

Figure 10:
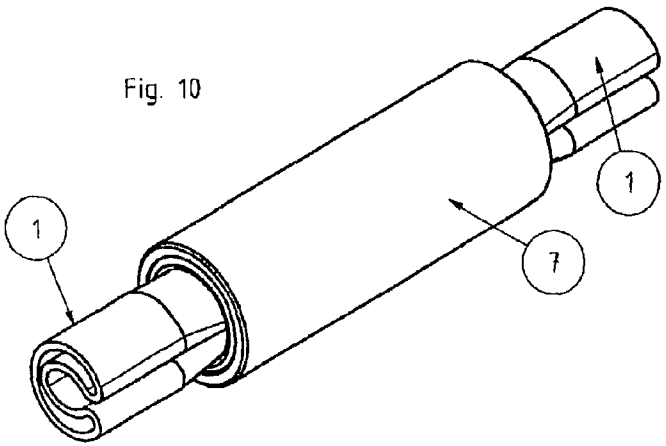
FIG. 10 shows the arrangement from FIG. 9 in an oblique view.

It is also recognizable in FIG. 26 that in the embodiment of welding with at least one opening 45 the unthreaded region, as are necessary in the embodiment as shown in FIGS. 9 and 10, in the case of closed welding of the adjacent ends of the expandable tubes 1 can be omitted.

The casing-like sleeve 7 on its two ends has cylindrical, unthreaded sections 47 so that the ring seals 11 can easily perform their sealing function. Between the threads in the sections 13 which are threads in opposite directions or in the same direction, in the region of the middle of the casing-like sleeve 7 there is an unthreaded section 49.

In summary, one embodiment of the invention can be described as follows.

A friction tube anchor has a tube 1 which can be expanded under the action of a pressurized medium and which is attached to a casing 6. The casing 6 is screwed into a threaded section 13 of the casing-like sleeve 7 and is sealed by ring packing 11 relative to the inside of the section 13. The casing-like sleeve 7 has another threaded section 14 in which selectively either another expandable tube 1 or an inflation adapter for feeding the pressurized medium for expanding the tube 1, or a fastening bolt, for example an eye bolt, can be screwed.

The invention claimed is:

1. A friction tube anchor, comprising:

an expandable tube;

a casing connected to the expandable tube; and a casing-like sleeve, the casing which is connected to the expandable tube is inserted into the casing-like sleeve, wherein a first section of the casing-like sleeve which is opposite a second section of the casing-like sleeve which holds the casing with the expandable tube is set up to accommodate another component, and wherein there is a region with an enlarged diameter between the first and second sections of the casing-like sleeve.

2. The anchor as claimed in claim 1, wherein the other component is another casing which is connected to another expandable tube of another friction tube anchor.

3. The anchor as claimed in claim 1, wherein an end of the expandable tube is made in the manner of open welding.

4. The anchor as claimed in claim 1, wherein an end of the expandable tube is made in the manner of closed welding.

5. The anchor as claimed in claim 1, wherein the region of the casing-like sleeve between the first and second sections of the casing-like sleeve is made unthreaded.

6. The anchor as claimed in claim 1, wherein there are internal threads in the first and second sections of the casing-like sleeve.

7. The anchor as claimed in claim 6, wherein the threads in the first and second sections are threads which run in the same direction or in opposite directions, specifically a right-hand thread and a left-hand thread.

8. The anchor as claimed in claim 1, wherein in the first and second sections of the casing-like sleeve there are round threads, and wherein the casing is provided with external round threads.

9. The anchor as claimed in claim 8, wherein the external round threads of the casing and those of the casing-like sleeve are corresponding threads.

10. The anchor as claimed in claim 1, wherein there is a seal between the casing-like sleeve and the casing.

11. The anchor as claimed in claim 10, wherein the seal is ring packing which is inserted into a groove of the casing, said groove is open to the outside.

12. The anchor as claimed in claim 11, wherein the groove for accommodating the ring packing is in a region of an end of the casing facing away from a free end of the expandable tube.

13. The anchor as claimed in claim 1, wherein an inflation adapter for supplying a pressurized medium can be inserted into the first section of the casing-like sleeve which is opposite the second section of the casing-like sleeve into which the casing which is connected to the expandable tube is inserted.

14. The anchor as claimed in claim 13, wherein the inflation adapter can be screwed into the first region of the casing-like sleeve.

15. The anchor as claimed in claim 1, wherein the other component is a fastening bolt.

16. The anchor as claimed in claim 15, wherein the casing which is connected to the expandable tube has an external thread which can be screwed into an internal thread in the second section of the casing-like sleeve.

17. The anchor as claimed in claim 16, wherein the casing externally has a round thread and the second section of the casing like sleeve has an internal round thread.

18. The anchor as claimed in claim 15, wherein the first section of the casing-like sleeve has a thread.

19. The anchor as claimed in claim 18, wherein threads in the second section and in the first section of the casing-like sleeve are threads in the same direction or in opposite directions.

20. The anchor as claimed in claim 18, wherein the first and second sections are threaded, threads in one of the first and second sections is a left-hand thread and threads in the other is a right-hand thread.

21. The anchor as claimed in claim 18, wherein the thread in the first section is a metric thread.

22. The anchor as claimed in claim 15, wherein the casing is sealed relative to an inside surface of the second section of the casing-like sleeve.

23. The anchor as claimed in claim 15, wherein the region between the first and second sections of the casing-like sleeve is unthreaded.

24. The anchor as claimed in claim 23, wherein the casing has an end which lies within the casing-like sleeve that is located in the region.

25. The anchor as claimed in claim 15, wherein the expandable tube is metal.

26. The anchor as claimed in claim 25, wherein the expandable tube is welded to the casing.

27. The anchor as claimed in claim 15, wherein the expandable tube on end which is connected to the casing is made in the manner of open welding.

28. The anchor as claimed in claim 15, wherein the expandable tube is connected to the casing in the manner of closed welding.

29. The anchor as claimed in claim 1, wherein a weld which closes the expandable tube in the manner of closed welding connects the expandable tube to the casing.

30. The anchor as claimed in claim 1, wherein an end of an inwardly pointed fold of the expandable tube is closed.

31. The anchor as claimed in claim 30, wherein the fold of the expandable tube is closed by a plug.

32. The anchor as claimed in claim 31, wherein the plug is connected to the expandable tube.

33. A friction tube anchor, comprising:

an expandable tube;

a casing connected to the expandable tube; and a casing-like sleeve, the casing which is connected to the expandable tube is inserted into the casing-like sleeve, wherein a first section of the casing-like sleeve which is opposite a second section of the casing-like sleeve which holds the casing with the expandable tube is set up to accommodate another casing connected to another expandable tube, wherein in the casings there are openings which are radially aligned, and wherein in ends of the expandable tubes which are connected to the casings there are holes flush with the openings.

34. A friction tube anchor, comprising:

an expandable tube;

a casing connected to the expandable tube; and a casing-like sleeve, the casing which is connected to the expandable tube is inserted into the casing-like sleeve, wherein a first section of the casing-like sleeve which is opposite a second section of the casing-like sleeve which holds the casing with the expandable tube is set up to accommodate a fastening bolt, and wherein a region between the first and second sections of the casing-like sleeve is made with an enlarged diameter.

35. A friction tube anchor, comprising:

an expandable tube;

a casing connected to the expandable tube; and a casing-like sleeve, the casing which is connected to the expandable tube is inserted into the casing-like sleeve, wherein a first section of the casing-like sleeve which is opposite a second section of the casing-like sleeve which holds the casing with the expandable tube is set up to accommodate a fastening bolt, and wherein there is at least one radial hole in a wall of the casing.

36. The anchor as claimed in claim 35, wherein in the expandable tube there is an opening which is flush with the hole in the casing.

37. A friction tube anchor, comprising:

an expandable tube;

a casing connected to the expandable tube; and a casing-like sleeve, the casing which is connected to the expandable tube is inserted into the casing-like sleeve, wherein a first section of the casing-like sleeve which is opposite a second section of the casing-like sleeve which holds the casing with the expandable tube is set up to accommodate another component, and wherein a weld in the manner of closed welding of the expandable tube is provided with at least one opening which leads to an interior of the expandable tube.

* * * * *